US006023950A

United States Patent [19]

Battistella

[11] Patent Number: 6,023,950

[45] Date of Patent: Feb. 15, 2000

[54] ARRANGEMENTS PROVIDED FOR DETERMINING THE TYPE OF TEXTILES IN THE WASHLOAD OF CLOTHES WASHING MACHINES

[75] Inventor: Silvio Battistella, Pordenone, Italy

[73] Assignee: Eletrolux Zanussi Elettrodomestici S.P.A., Pordenone, Italy

[21] Appl. No.: 08/566,839

[22] Filed: Dec. 4, 1995

[30] Foreign Application Priority Data

Dec. 13, 1994 [IT] Italy ..... PN94.A 0075

[51] Int. Cl.[7] ..... D06F 33/02

[52] U.S. Cl. ..... 68/12.04; 68/12.05; 68/12.21

[58] Field of Search ..... 68/12.04, 12.05, 68/12.21

[56] References Cited

U.S. PATENT DOCUMENTS

| | | | |
|---|---|---|---|
| 2,302,923 | 11/1942 | Zimarik | 68/12.05 |
| 3,359,766 | 12/1967 | Haas | 68/12.04 |
| 4,503,575 | 3/1985 | Knoop et al. | 68/12.05 |
| 4,711,103 | 12/1987 | Mori et al. | 68/12.05 |
| 5,144,819 | 9/1992 | Hiyama et al. | 68/12.04 |
| 5,161,393 | 11/1992 | Payne et al. . | |
| 5,230,228 | 7/1993 | Nakano et al. | 68/12.04 |
| 5,259,217 | 11/1993 | Civanelli et al. | 68/12.04 |

FOREIGN PATENT DOCUMENTS

| | | | |
|---|---|---|---|
| 2854148 | 6/1979 | Germany | 68/12.04 |
| 61-94684 | 5/1986 | Japan | 68/12.05 |
| 61-137598 | 6/1986 | Japan | 68/12.04 |
| 62-8791 | 1/1987 | Japan | 68/12.04 |
| 2070648 | 9/1981 | United Kingdom | 68/12.05 |

*Primary Examiner*—Frankie L. Stinson

*Attorney, Agent, or Firm*—Pearne, Gordon, McCoy & Granger LLP

[57] ABSTRACT

A clothes washing machine is provided with a wash tub (1) and a rotating arm (2) accommodated within the wash tub and adapted to contain washload items and capable of being driven so as to rotate both at high and low rotating speeds. A pressure switch (3) is arranged within an appropriate air chamber connected with the intake thereof at a location (4) situated below the lower level (5) of the wash tub. An inlet and shut-off (6) governs the water supply from the water delivery mains to the wash tub. The inlet and shut-off is arranged to detect average soaking characteristics of the washload items placed in the drum by first measuring their overall capacity of absorbing a defined amount of water, and then processing the measured capacity on the basis of the weight of the washload items, the weight being known. The machine operates by letting defined water amounts into the wash tub, wherein the water is allowed to be absorbed by the washload up to the maximum soaking capacity thereof and the amount of absorbed water is then measured at the difference between the amount of water let into the tub and the residual amount of water. Alternatively, the machine operates by performing a substantially similar procedure, except the washload undergoes a spin-extraction phase before the amount of residual water is measured and the calculations are made on the basis of the different water retention characteristics of the spin-extracted washload items.

23 Claims, 5 Drawing Sheets

ARRANGEMENTS PROVIDED FOR DETERMINING THE TYPE OF TEXTILES IN THE WASHLOAD OF CLOTHES WASHING MACHINES

BACKGROUND OF THE INVENTION

The present invention refers to a clothes washing machine, in particular a household-type clothes washing machine, provided with special means and related operating modes to enable the particular type of textiles, or mix thereof, forming the washload in the drum of said washing machine to be appropriately identified.

Although the present invention relates particularly to front-loading clothes washing machines, and for reasons of greater simplicity and convenience the following description refers to such a type of washing machines, it will be appreciated that the invention may similarly apply to other types of washing machines, such as top-loading washing machines.

Washing machines are known in the art that are provided with means adapted to identify the type of textiles, or mix thereof, forming the particular washload being handled in the drum of the washing machine. A purpose of such identification is to provide the machine with the ability of selecting the washing cycle automatically, with the various process parameters selected so as to optimize the operation of the machine and the washing results. For instance, the U.S. Pat. No. 5,161,393 to the name of General Electric Company discloses a quite effective method for identifying the type of textiles in the washload. However, such a method only applies to washing machines having their drum rotating about a vertical axis, so that it is not suitable for use in conjunction with the great majority of washing machines having their drum rotating about a horizontal axis, that is, nearly all of the European-built machines. Furthermore, such a method is a sort of a trial-and-error one based on a set of successive measurements, so that it is quite complex and time-consuming.

SUMMARY OF THE INVENTION

It would therefore be desirable, and is in fact a main purpose of the present invention, to provide a clothes washing machine that has a drum rotating about a horizontal axis and is, nevertheless, capable of performing the measurements required to identify the type of textiles in the washload by using safe, reliable, inexpensive methods and means on the basis of readily available technologies.

DESCRIPTION OF THE PREFERRED EMBODIMENTS

The term "water" will be used in the following description to mean both washing liquor and rinsing water. Such a simplification, however, will by no means affect the clarity of the disclosure considering the context in which such terms are being used, as anyone skilled in the art will be able to readily understand.

Figure 1:
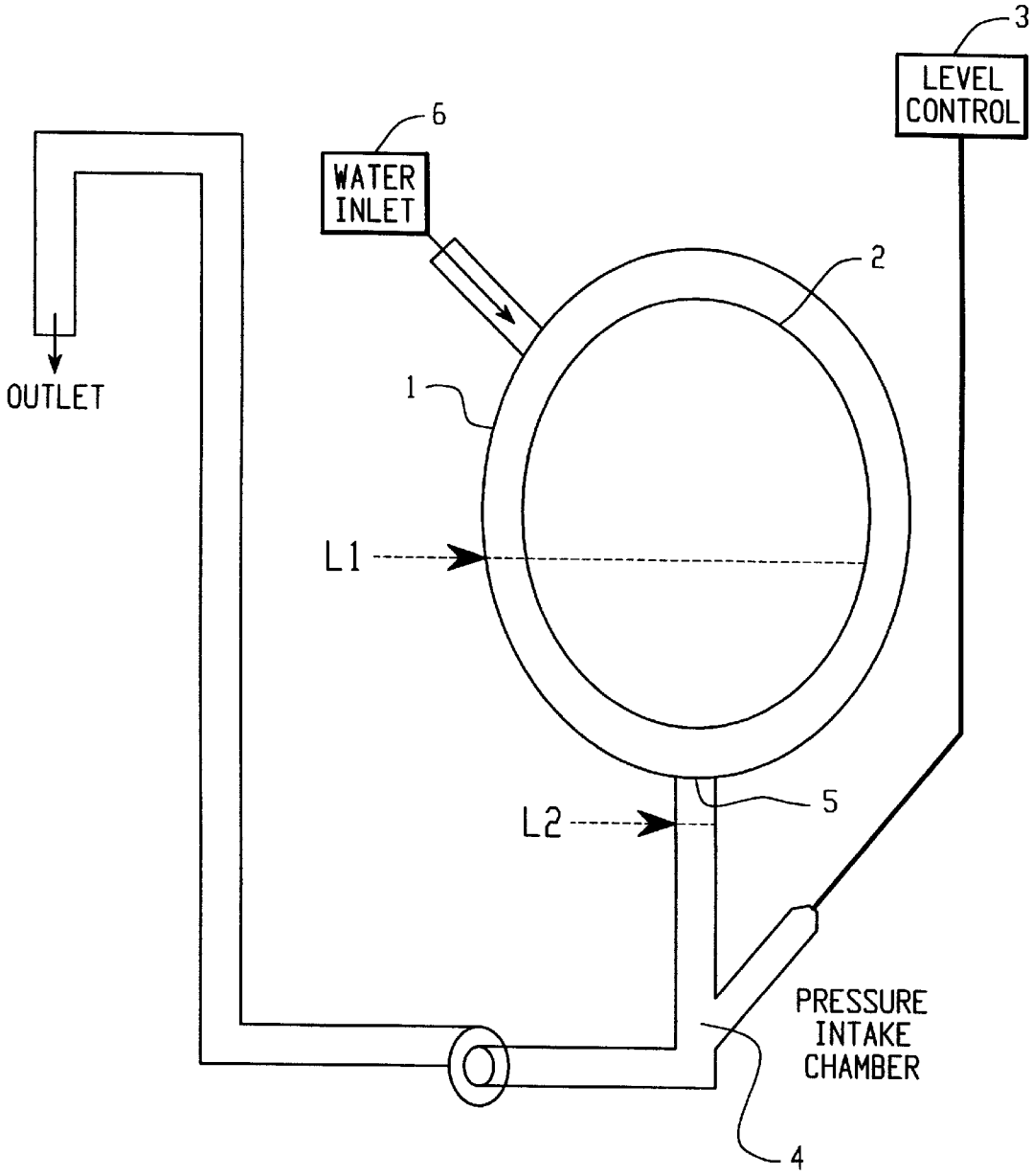
FIG. 1 is a schematic view of a first arrangement of component parts and levels of a clothes washing machine according to the present invention.

Referring now to FIG. 1, which illustrates a preferred embodiment of the present invention, a solution according to the present invention is explained along with the related operation principles.

The described clothes washing machine comprises a washing tub 1, a drum 2 rotating inside said washing tub and adapted to hold the washload, and a pressure switch 3 having an air intake 4 situated at a position below the lower edge 5 of the washing tub. The clothes washing machine is further provided with programming and controlling means, including control means 6, such as an electromagnetic valve, for opening and closing the water supply from an external source. A recirculation circuit (not shown) is provided for recirculating the water contained in the tub, the recirculation circuit being adapted to be selectively activated by said programming and controlling means of the machine and to take up the water from the bottom of the tub and let the water flow back into or onto the drum so that all washload items contained in said drum are, in as short a time as possible, affected simultaneously by said flow of recirculated water.

Textile items to be washed are largely known to have water soaking characteristics that can vary to a very large extent according to the particular nature of their fiber material and the manner in which the material has been processed. It is also a commonly known fact that water soaking characteristics are most marked in items made of sponge-cloth, whereas soaking characteristics are less marked in cottons and/or fabrics made of man-made fibers. The term "soaking" is used here to mean the amount of liquor taken up by the cloth before saturation, that is, before any further liquor added starts to be released. This technical term, like some other terms used here, is a part of the common knowledge of those skilled in the art and, as such, it is assumed to be commonly known.

The present invention therefore consists substantially in filling a definite amount of water into the tub, including also all possible cavities associated therewith, such as for instance an outlet pipe, an airtrap of the pressure switch and the like. Then the clothes are soaked as much as possible by said water, possibly by subsequently filling in additional amounts of water as needed to restore the water level. The amount of residual water is measured after the clothes have been soaked to saturation. Finally, based on the weight of the clothes loaded into the drum and the amount of water absorbed, the average soaking characteristic of the washload is calculated and, hence, the mix of textile types in the washload is determined.

Identifying the mix of textile types included in the washload on the basis of their water absorption capacity and, of course, the respective weight is an experimentally viable technique that is widely known in the art, so that no further explanation will be given here in this connection.

Figure 2:
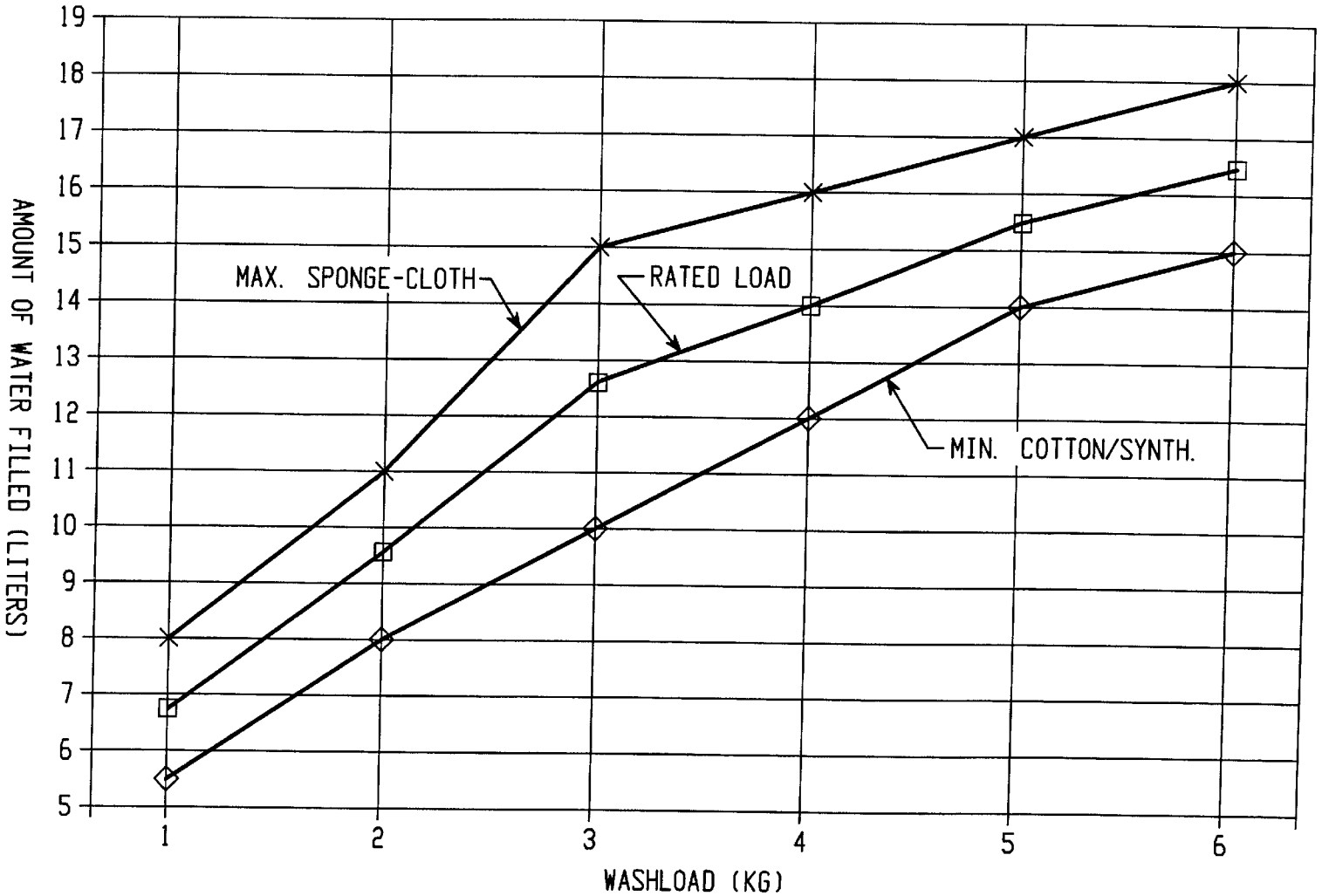
FIG. 2 is a graph illustrating diagrammatically the water absorption capacity of textiles of different nature.

The diagram appearing in FIG. 2 represents on the ordinate the amounts, in liters, of water absorbed by several types of fabrics the weights of which are plotted on the abscissa, wherein the upper curve A refers to sponge-cloth, while the lower curve C refers to cotton and synthetics.

Since the nature of the fabrics, which is not known, is identified on the basis of the capacity thereof to absorb water, it proves necessary that a pre-determined amount of water be filled into the tub, and the related level be checked, after allowing the fabrics being tested to attain their highest inherent soaking points by letting the drum rotate a certain number of times at a low speed with the recirculation circuit operating normally, so that all textile material can be wetted and, therefore, absorb water.

It is, however, necessary that the amount of water to be filled be defined and such an amount may be an arbitrary value. What really matters is the percentage of water absorbed after agitating or rotating so as to enable each type of fabric to attain its highest possible soaking point. There is only one limitation in this connection, said arbitrary value shall in any case lie between the highest and lowest theoretically possible water absorption values (curves A and C).

At this point the machine, upon being given a further command or by acquiring it directly in some other manner, which is not a part of the present invention, acquires information concerning the weight of the washload introduced in the drum.

A water fill curve B is then selected that is exactly intermediate with respect to both above-mentioned extreme curves and, therefore, corresponds to a hypothetical washload formed by both sponge-cloth and cotton fabrics on a fifty-fifty weight-percent basis.

As a result, the washing machine fills in the amount of water corresponding to the total weight of the washload as detected directly or fed as an input into the programming system by suitable means. For instance, 12.5 liters of water would be filled in for a washload with a total weight of 3 kg, as shown in FIG. 2.

Upon completion of this phase, the programming system controls the machine so as to cause the drum to complete a number of rotations and the recirculation circuit to be activated until all of the textile material in the washload has the opportunity of being wetted and absorbing water. In the case that the water is in excess, excess water is released. As a result, with reference to FIG. 1, the level of the water in the tub will shift from the original level L1 to a new level L2, which is duly detected by the pressure switch 3.

At this point, the programming and control system of the machine, which will have been appropriately programmed and supplied with all necessary data, identifies and automatically expresses the average soaking value of the fabrics being tested and, hence, the type of fabrics, or mix of fabrics, having a behavior corresponding to the soaking value detected.

It may be observed that, when the water is being filled in up to its normal level, the water touches and penetrates the walls of the drum and is absorbed by the clothes, thereby generating a measurement error which is proportional to the washload and its overall water absorption capacity.

Such an error induces a flow rate to be calculated which is quite often smaller than the actual flow rate. It therefore ensues that time-controlled water filling is almost invariably wrong, in that more water is filled than actually needed. However, such a slight error can be easily compensated by an appropriate correction of the calculation means based on the behavior determined experimentally.

A variation of the aforedescribed procedure consists in filling an excessive amount of water, for a given weight of the washload, so as to fully soak any possible type of fabric.

Figure 3:
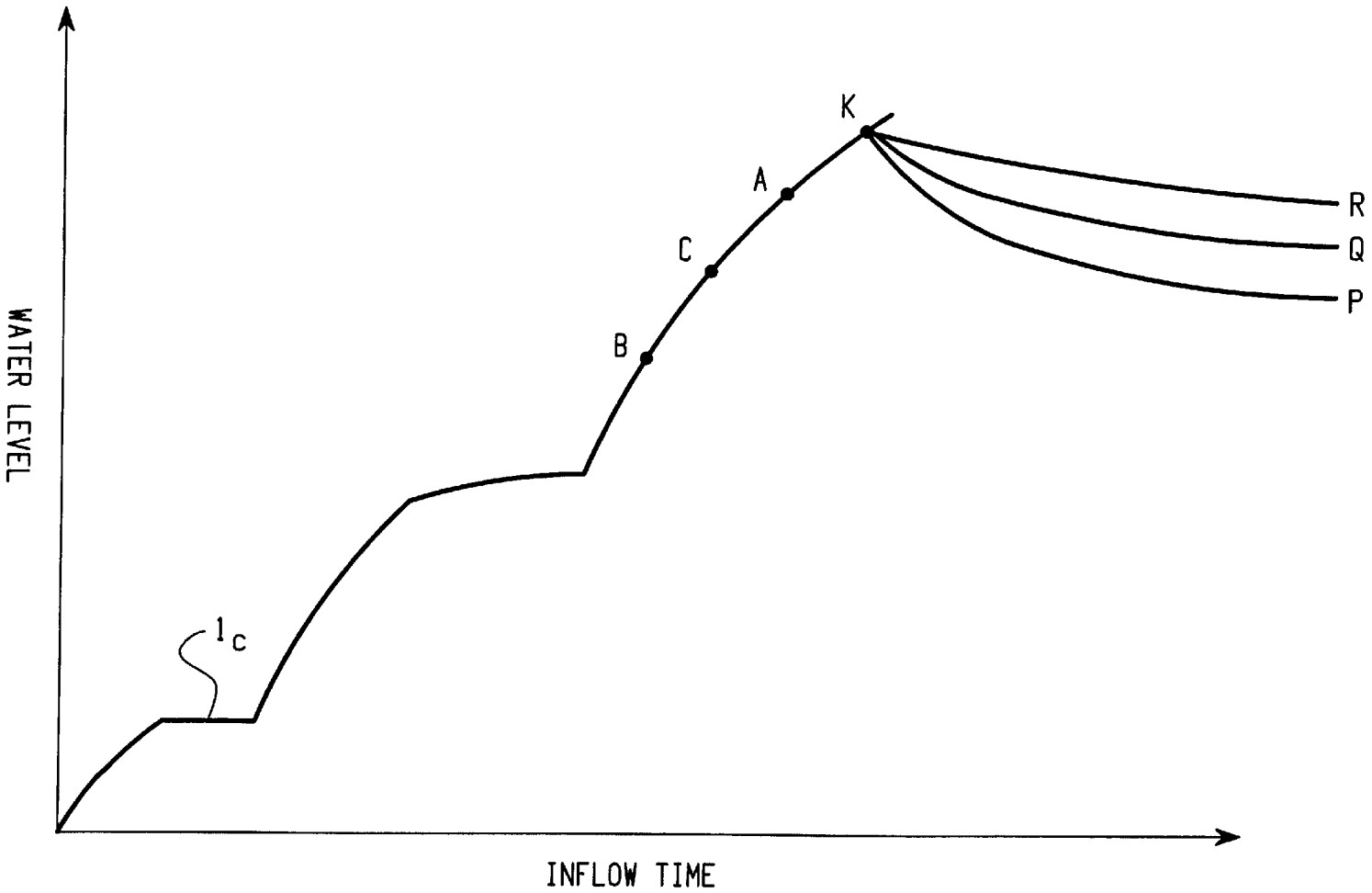
FIG. 3 is a graph illustrating water level vs. time, with the machine drum both at a standstill and rotating, for different types of textiles.

With reference to FIG. 3, the curve indicates the water level in the tub, with the drum at a standstill, as a function of the inflow time (on the abscissa) of water from outside for a certain total weight of the washload. A step can be noticed in this curve which corresponds to the moment at which the level reaches up to the lower edge of the drum, and the points A, B and C along the curve correspond to respective types of fabrics or mix of fabrics, according to the aforegiven definitions. The point K corresponds to the level of excess water selected for any type of fabric and referred to a respective weight of the washload.

By causing the drum to start rotating and the recirculation pump to start operating, the level defined by the water level falls according to the water absorption by the clothes. From point K, a plurality of curves are defined. Among these, the curve P defines the changing level for a highly absorbent type of fabric (sponge-cloth), the curve Q gives the same indication for a type of fabric with a medium absorbency (eg. PES/cotton), and the curve R indicates the same for a low-absorbing type of fabric (synthetics).

From the graphs it therefore ensues that, after the level has stabilized, that is, after a pre-determined period of drum rotation and water recirculation, it is possible for the mix of types of fabrics in the washload to be recognized and identified (according to the respective absorption rates) by measuring said level and comparing it with experimental data previously stored in the system, as well as on the basis of the weight of the washload.

Figure 5:
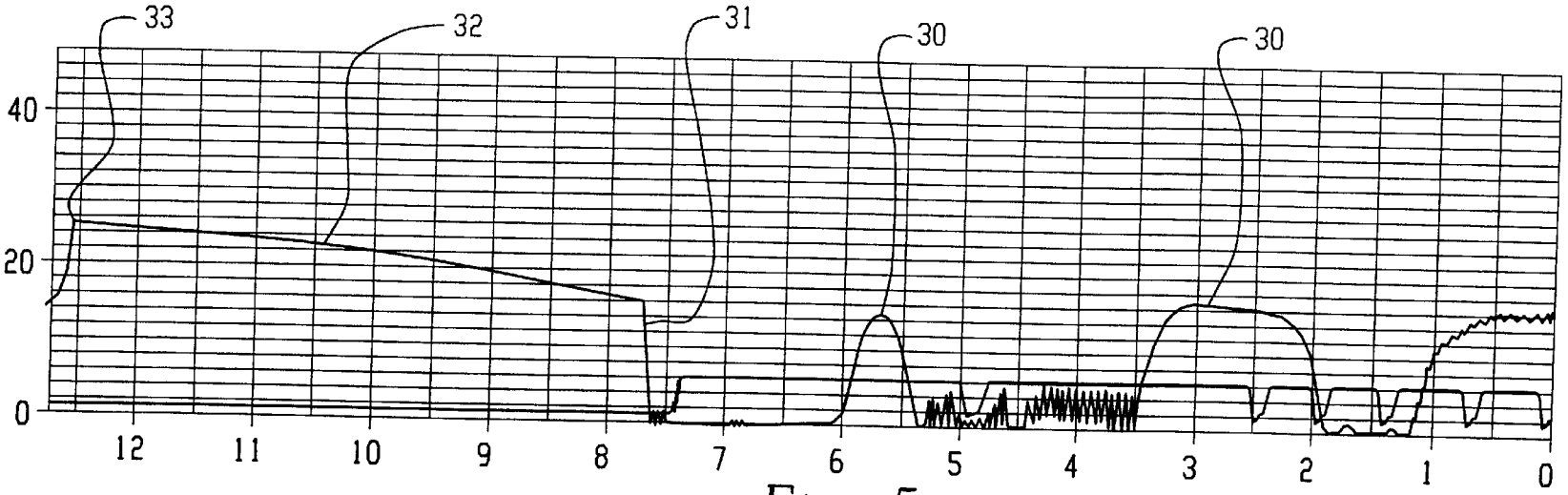
FIG. 5 is a graph illustrating diagrammatically the evolution of the level of the water measured in a clothes washing machine according to the present invention as a function of the progression of the washing cycle, for a low-absorbing type of textile.
Figure 6:
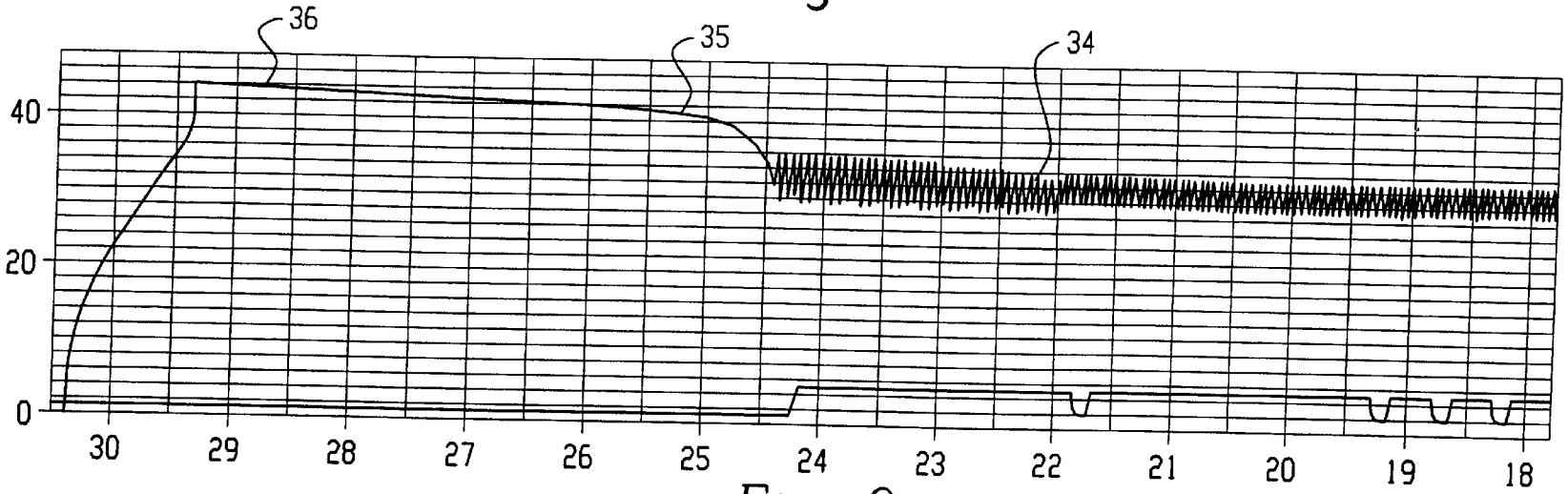
FIG. 6 is a view of a similar diagram as the one shown in FIG. 5, but referring to a highly absorbing type of textiles, all other conditions being the same.

In order to better emphasize the behavior of the water level under extreme conditions of the type of fabric in the washload, the two FIGS. 5 and 6 should be closely observed. FIG. 5 illustrates an example of a graph (to be read from right to left) relating to the level of the water as measured in a machine according to the above-described operating mode in which an excess amount of water is filled in and this water is entirely retained by the high-absorbency clothes during a plurality of rotations of the drum under water recirculation conditions. In some phases 30, the level tends to increase and then to correspondingly decrease down to almost nil owing to the instability of the soaking process. Subsequently, the level tends to first increase in a very sharp manner through a certain distance 31 and then slow its rate of increase markedly over a subsequent distance 32, until it substantially stabilizes at a level 33. The same experiment carried out with a low-absorbency type of fabric, as shown in FIG. 6, indicates that the level stays high and substantially stable through a distance 34, in which the rapid variations are indicative of oscillations induced by the rotation of the drum. Then the level increases in a progressive manner, although at a decreasing rate, through a further distance 35, until it eventually stabilizes at a final value 36. The difference between said two stable levels 33 and 36 that, in conjunction with the machine parameters that are already stored in the system and previous experimental data and the actual weight of the washload, enables the mix of types of fabrics in the washload to be calculated (as a function of the respective absorption rates).

A variant form of the aforedescribed methods for measuring and calculating the absorbency characteristics of the fabrics is implemented by making use of the different water retention characteristics of the fabrics after wringing or spinning as compared to the water retention capacity of the same fabrics before wringing or spinning. It has, in fact, been observed experimentally that the accuracy in measuring water retention is usually greater (in the sense of a lesser variability under the same conditions) in the case of spin-extracted clothes with respect to clothes which are only wetted or soaked, but not spin-extracted.

Such a variant consists in carrying through an operating sequence that ensures that all fabrics being tested are entirely wetted and soaked. The fabrics undergo a spin-extraction phase while maintaining such conditions in the tub as to make sure that the level of the free surface of the water is, in all cases, lower than the lowest level of the side wall of the drum (this, of course, in order to ensure the effectiveness of the spin-extraction action). Then, the water absorbed is calculated based on the difference between the total amount of water filled in and the amount of residual water remaining in the tub. The absorbed water is then compared, with reference to the weight of the washload, with previously recorded and stored experimental data relating to a plurality of measurements made on washloads of known weight subjected to a similar spin-extraction process with known contents in terms of mix of types of fabrics.

Based on such a comparison, it is then quite simple to identify, for each weight of the washload, the mix of types of fabrics to be determined.

According to such a variant, the machine goes through a sequence consisting in:

filling into the tub such an amount of water that the level thereof does not exceed the lowest level of the side wall of the drum and storing this amount in a memory of the program controller;

carrying out a plurality of operation sequences, each one of which comprises a plurality of low-speed drum rotation cycles and high-speed drum rotation cycles under simultaneous water recirculation, while recording and storing the level of the water at the end of each sequence of high-speed drum rotation cycles;

carrying out a plurality of level-restoring water additions alternating with said plurality of operation sequences until the level of water measured at the end of said plurality of high-speed drum rotation cycles is equal to or exceeds the previously recorded level, said level-restoring water additions being limited in all cases so as to make sure that the free surface of the water bath in the tub remains constantly below the lowest level of the side wall of the drum;

calculating the amount of water absorbed by the washload in the drum by subtracting the amount of water corresponding to the last recorded level from the total amount of water filled into the tub; and calculating the "washload-to-absorbed water" ratio and selecting the mix of types of fabrics through a comparison with a previously stored database.

According to such a process, the level tends to stabilize under all circumstances below the original level, owing to the water being absorbed by the clothes. This fact, however, does not cause any problem, since such a case is fully taken into account by the planned operating modalities which provide that, under such a circumstance, the aforedescribed sequence of successive water additions, spin-extractions, measurements and comparisons is carried through or continued.

The above described variant allows for a particularly advantageous improvement in view of accelerating the measurement time requirements. It is, in fact, possible for the minimum amount of water to be filled to be assessed just once, allowing it to be entirely absorbed by the clothes during a low-speed rotation phase of the drum under water recirculation conditions for a few minutes (approx. 3 minutes), then restoring operation according to the aforedescribed modalities starting after the first level-restoring water addition, instead of carrying out a first water fill procedure up to the limit set by the maximum attainable level (side wall of the drum) and then going through an extended sequence of water additions, etc. This variant enables the overall time requirements to be reduced by allowing an amount of water corresponding to several successive water fills and water additions, which would have required a correspondingly longer time to be completed, to be filled in just once, that is, the first time.

A particularly advantageous feature, which is applicable to the cases in which the amount of water to be filled in has to be pre-determined, regardless of the level that can be reached by the water in the tub, is described below.

Such a feature applies for instance to the case of a washload made up of synthetic/cotton fabrics, where the water filled in to soak such fabrics while maintaining, during the subsequent stabilizing cycles, a significant pressure on the filter bell-shaped trap for an appropriately long period of time.

Quite to the contrary, in the case of a washload made up by sponge-cloth fabrics, the same amount of water proves insufficient in view of ensuring a total soaking effect and, therefore, it is absorbed rapidly and entirely under an abrupt fall of the pressure below significant values in a relatively short time, so that it proves impossible to record the new level.

In order to eliminate the drawback of the pressure switch not being able to directly measure the amount of water filled in, it is necessary that the amount of water filled in be accurately measured, regardless of the pressure head existing on the pressure switch.

This can be achieved by letting the water be filled in under time control, once that the flow rate, which depends substantially on both the water inlet means and the water delivery line pressure, is known.

Figure 4:
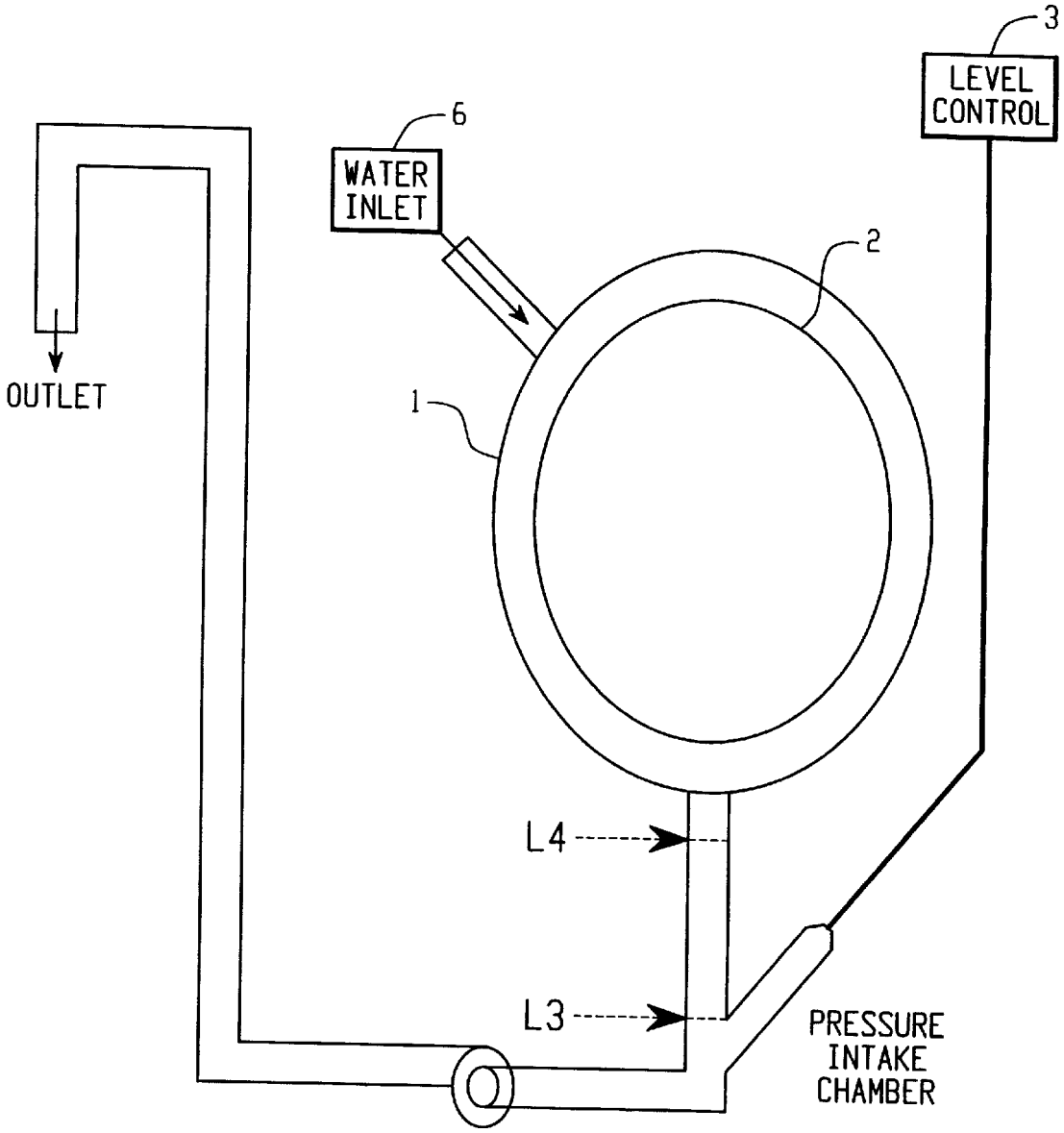
FIG. 4 is a schematic view of a second arrangement of component parts and levels of a clothes washing machine according to the present invention.

However, for the actual flow rate to be known, considering that it may vary due to a number of factors, among which the water supply pressure from the mains is certainly a very significant one, the following procedure shall be carried out, by first bringing the water level in the conduit up to the level L3 and then defining a second level L4 (see FIG. 4) lying above the level L3 and preferably situated in the outlet conduit in such a manner that the volume V between said levels is known. At this point, the flow-rate measurement sequence is started by switching in the water inlet system and recording the time taken by the water level in said conduit to rise from the level L3 to the level L4. The V-to-time ratio then gives the exact indication of the actual flow rate at which water is filled in.

Once such a flow rate is known, it will be possible for the programming and controlling system of the machine to switch in the water inlet means of the machine just for the time required to let into the tub the exact amount of water needed, with an accuracy which is of course within the tolerances allowed for by the sensitivity of the sensors of the mechanical configuration adopted and the accuracy of calculation arrangement used.

Finally, a measurement error may in some cases be induced by the fact that, during the water filling phase, a part of such water, while flowing down along the wall of the drum, penetrates the same drum where it wets part of the washload. This, of course, brings about an error in the calculation of the flow rate, in the sense that a lower flow rate than the actual one is calculated by the system.

In order to eliminate such a possible error, provisions should be appropriately taken so as to prevent the inflowing water from entering in contact with the clothes contained in the drum. This can be achieved by filling in the water directly from: the lower portion of the tub.

It will be appreciated that anyone skilled in the art is able to identify further solutions and optimizations in the use of the elements and parts associated therewith by relying on techniques and knowledges which are readily available in the art. Therefore, although it has been described using generally known terminology, the present invention should not be considered as being limited by the examples given in this description, since those skilled in the art can add a number of variations and modifications thereto. The appended claims are therefore meant to include any possible, obvious modification that may fall within the common abilities of those skilled in the art.

What is claimed is:

1. A clothes washing machine comprising a washing tub (1), a drum (2) rotating within said washing tub and adapted to hold washload items and to be rotatably driven at a low speed and a high speed, a pressure switch (3) arranged within an appropriate air pressure switch (3) arranged within an appropriate air chamber connected with a pressure intake of the tub at a point (4) situated below a lowest level (5) of the tub, and inlet and shut-off means (6) governing water supply from water delivery mains to the washing tub, characterized in that the machine is arranged to detect average soaking characteristics of the washload items placed in the drum by first measuring overall capacity of the items for absorbing a definite amount of water and then processing said measured capacity based on a known weight of said washload items to determine a type of textiles comprising the washload items; the amount of water filled in is based on a flow rate controlled by the water inlet means (6) provided to deliver water into the tub; and said flow rate is determined by filling water into a known volume between a first reference level (L3) and a second reference level (L4) and recording a time needed for the water level to rise from said first level (L3) to said second level (L4).

2. A clothes washing machine according to claim 1, and further provided with a circuit for recirculation of water contained in the tub, characterized in that said measurement is carried out according to the following sequence of phases:

filling into the tub an amount of water calculated so that said amount of water is an intermediate level (L1) between levels representing a highest possible and a lowest possible soaking capacity of the items, said levels being based on the known weight of said washload items;

executing a plurality of low-speed rotation cycles of the drum under simultaneous operation of the water recirculation circuit, until said washload items have either absorbed the whole amount of water that the items are capable of absorbing, in the case that the available amount water is sufficient for that purpose, or absorbed the whole available amount of water without becoming entirely soaked therewith, in the case that the available amount of water is not sufficient to ensure full soaking;

measuring a water level (L2) and calculating an amount of absorbed water; and calculating a washload weight to amount-of-absorbed-water ratio and identifying the type and/or mix of types of fabrics in the washload therefrom.

3. A clothes washing machine according to claim 2, characterized in that the amount of water filled in is based on a flow rate controlled by the water inlet means (6) provided to deliver water into the tub.

4. A clothes washing machine according to claim 3, characterized in that said flow rate is determined by filling water into a known volume between a first reference level (L3) and a second reference level (L4) and recording a time needed for the water level to rise from said first level (L3) to said second level (L4).

5. A clothes washing machine according to claim 4, characterized in that said measurement of the flow rate is carried out in advance of the water filling, a first water fill being carried out so as to reach said first reference level (L3) before starting with the determination of the flow rate of said water inlet means (6).

6. A clothes washing machine according to claim 1, and further provided with a circuit for recirculation of water contained in the tub, characterized in that said measurement is carried out according to the following sequence of phases:

filling into the tub of an amount of water determined so as to ensure full soaking of any type of washload item based on the weight of said washload and storing information concerning such amount of water in a memory;

executing a plurality of low-speed rotation cycles of the drum under simultaneous operation of the water recirculation circuit until said washload items have absorbed the whole amount of water that the items are capable of absorbing;

measuring a water level under conditions of substantial stability thereof; and calculating a washload weight to detected-water-level ratio and identifying a mix of types of fabrics in the washload by searching and recognizing of a closest applicable ratio included in a previously stored experimental database.

7. A clothes washing machine according to claim 6, characterized in that the amount of water filled in is based on a flow rate controlled by the water inlet means (6) provided to deliver water into the tub.

8. A clothes washing machine according to claim 7, characterized in that said flow rate is determined by filling water into a known volume between a first reference level (L3) and a second reference level (L4) and recording a time needed for the water level to rise from said first level (L3) to said second level (L4).

9. A clothes washing machine according to claim 8, characterized in that said measurement of the flow rate is carried out in advance of the water filling, a first water fill being carried out so as to reach said first reference level (L3) before starting with the determination of the flow rate of said water inlet means (6).

10. A clothes washing machine according to claim 1, and further provided with a circuit for recirculation of water contained in the tub, characterized in that said measurement is carried out by:

filling such an amount of water into the tub that a free surface of the water reaches up to a lowest level of the side wall of the drum, and storing information concerning such an amount;

carrying out a plurality of operation sequences, each one of which comprises a plurality of low-speed rotation and high-speed rotation cycles of the drum under simultaneous recirculation of the water, and recording a water level at the end of each sequence of high-speed rotation cycles of the drum;

carrying out a plurality of level-restoring water additions alternating with said plurality of operation sequences until a condition is reached in which a water level measured at the end of said plurality of high-speed rotation cycles of the drum is equal to or exceeds the previously recorded level, said level-restoring water additions being limited in all cases in such a manner that the free surface of the water in the tub remains constantly below the lowest level of the side wall of the drum;

calculating the amount of water absorbed by the washload contained in the drum by subtracting the amount of water corresponding to the last recorded level from the total amount of water filled in the tub; and calculating a washload to weight amount-of-absorbed-water ratio and identifying the mix of types of fabrics in the washload therefrom.

11. A clothes washing machine according to claim 10, characterized in that the first water fill is carried out by filling into the tub an amount of water judged to be capable of being absorbed entirely by the washload, regardless of the level reached by said water fill, during the subsequent operation sequence at both low and high speed rotation of the drum under water recirculation conditions.

12. A clothes washing machine according to claim 11, characterized in that the amount of water filled in is based on a flow rate controlled by the water inlet means (6) provided to deliver water into the tub.

13. A clothes washing machine according to claim 12, characterized in that said flow rate is determined by filling water into a known volume between a first reference level (L3) and a second reference level (L4) and recording a time needed for the water level to rise from said first level (L3) to said second level (L4).

14. A clothes washing machine according to claim 13, characterized in that said measurement of the flow rate is carried out in advance of the water filling, a first water fill being carried out so as to reach said first reference level (L3) before starting with the determination of the flow rate of said water inlet means (6).

15. A clothes washing machine according to claim 10, characterized in that the amount of water filled in is based on a flow rate controlled by the water inlet means (6) provided to deliver water into the tub.

16. A clothes washing machine according to claim 15, characterized in that said flow rate is determined by filling water into a known volume between a first reference level (L3) and a second reference level (L4) and recording a time needed for the water level to rise from said first level (L3) to said second level (L4).

17. A clothes washing machine according to claim 16, characterized in that said measurement of the flow rate is carried out in advance of the water filling, a first water fill being carried out so as to reach said first reference level (L3) before starting with the determination of the flow rate of said water inlet means (6).

18. A clothes washing machine according to claim 1, characterized in that said measurement of the flow rate is carried out in advance of the water filling, a first water fill being carried out so as to reach said first reference level (L3) before starting with the determination of the flow rate of said water inlet means (6).

19. A clothes washing machine comprising a washing tub (1), a drum (2) rotating within said washing tub and adapted to hold washload items and to be rotatably driven at a low speed and a high speed, a pressure switch (3) arranged within an appropriate air chamber connected with a pressure intake of the tub at a point (4) situated below a lowest level (5) of the tub, inlet and shut-off means (6) governing water supply from water delivery mains to the washing tub, and a circuit for recirculation of water contained in the tub characterized in that the machine is arranged to detect average soaking characteristics of the washload items placed in the drum by first measuring overall capacity of the items for absorbing a definite amount of water and then processing said measured capacity based on a known weight of said washload items to determine a type of textiles comprising the washload items, wherein said measurement of overall absorbing capacity is carried out by:

filling such an amount of water into the tub that a free surface of the water reaches up to a lowest level of the side wall of the drum, and storing information concerning such an amount;

carrying out a plurality of operation sequences, each one of which comprises a plurality of low-speed rotation and high-speed rotation cycles of the drum under simultaneous recirculation of the water, and recording a water level at the end of each sequence of high-speed rotation cycles of the drum;

carrying out a plurality of level-restoring water additions alternating with said plurality of operation sequences until a condition is reached in which a water level measured at the end of said plurality of high-speed rotation cycles of the drum is equal to or exceeds the previously recorded level, said level-restoring water additions being limited in all cases in such a manner that the free surface of the water in the tub remains constantly below the lowest level of the side wall of the drum;

calculating the amount of water absorbed by the washload contained in the drum by subtracting the amount of water corresponding to the last recorded level from the total amount of water filled in the tub; and calculating a washload to weight amount-of-absorbed-water ratio and identifying the mix of types of fabrics in the washload therefrom.

20. A clothes washing machine according to claim 19, characterized in that the first water fill is carried out by filling into the tub an amount of water judged to be capable of being absorbed entirely by the washload, regardless of the level reached by said water fill, during the subsequent operation sequence at both low and high speed rotation of the drum under water recirculation conditions.

21. A clothes washing machine according to claim 19, characterized in that the amount of water filled in is based on a flow rate controlled by the water inlet means (6) provided to deliver water into the tub.

22. A clothes washing machine according to claim 21, characterized in that said flow rate is determined by filling water into a known volume between a first reference level (L3) and a second reference level (L4) and recording a time needed for the water level to rise from said first level (L3) to said second level (L4).

23. A clothes washing machine according to claim 22, characterized in that said measurement of the flow rate is carried out in advance of the water filling, a first water fill being carried out so as to reach said first reference level (L3) before starting with the determination of the flow rate of said water inlet means (6).

* * * * *

UNITED STATES PATENT AND TRADEMARK OFFICE

CERTIFICATE OF CORRECTION

PATENT NO. : 6,023,950

DATED : February 15, 2000

INVENTOR(S) : Battistella

It is certified that error appears in the above-indentified patent and that said Letters Patent is hereby corrected as shown below:

On the Title Page, Item [73], delete "Eletrolux" and insert --Electrolux--.

Column 4, Line 4, after "step" insert --$1_c$--.

Signed and Sealed this

Second Day of January, 2001

*Attest:*

*Attesting Officer*

Q. TODD DICKINSON

*Commissioner of Patents and Trademarks*